US009163890B2

(12) United States Patent
Heizer

(10) Patent No.: US 9,163,890 B2
(45) **Date of Patent: *Oct. 20, 2015**

(54) TRIGGER MECHANISM

(71) Applicant: Heizer Defense, LLC, Pevely, MO (US)

(72) Inventor: Charles K. Heizer, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 48 days.

This patent is subject to a terminal disclaimer.

(21) Appl. No.: 13/662,506

(22) Filed: Oct. 28, 2012

(65) Prior Publication Data

US 2013/0104436 A1 May 2, 2013

Related U.S. Application Data

(60) Provisional application No. 61/552,499, filed on Oct. 28, 2011.

(51) Int. Cl.
*F41A 19/10* (2006.01)
*F41A 19/12* (2006.01)
*F41A 19/14* (2006.01)

(52) U.S. Cl.
CPC ..... *F41A 19/10* (2013.01); *F41A 19/12* (2013.01); *F41A 19/14* (2013.01)

(58) Field of Classification Search
CPC ..... F41A 19/10; F41A 19/12; F41A 19/14
USPC ..... 42/69.01–69.03
See application file for complete search history.

(56) References Cited

U.S. PATENT DOCUMENTS 1,637,079 A * 7/1927 Karner, Jr. ..... 42/69.01
4,109,402 A 8/1978 Guardamino
4,384,422 A 5/1983 Röh
4,400,900 A 8/1983 Hillberg et al.
4,407,085 A 10/1983 Hillberg et al.
4,819,358 A 4/1989 Eder
5,050,480 A 9/1991 Knight, Jr.
5,822,903 A 10/1998 Davis, Sr.
6,101,918 A * 8/2000 Akins ..... 89/129.01
7,086,191 B2 8/2006 Orr
7,165,352 B2 1/2007 Langlotz
7,331,136 B2 2/2008 Geissele
7,500,327 B2 3/2009 Bubits
7,661,220 B2 2/2010 Crandall
D686,685 S * 7/2013 Kohout ..... D22/104
8,495,831 B1 * 7/2013 Kohout ..... 42/8
D707,780 S * 6/2014 Heizer et al. ..... D22/104
D709,580 S * 7/2014 Heizer et al. ..... D22/104
2009/0044437 A1 2/2009 Zajk
2013/0205632 A1 * 8/2013 Kohout ..... 42/8

* cited by examiner

*Primary Examiner* — Bret Hayes
*Assistant Examiner* — Benjamin Gomberg
(74) *Attorney, Agent, or Firm* — CreatiVenture Law, LLC; Dennis J M Donahue, III

(57) ABSTRACT

A trigger mechanism has a hammer, a hammer spring, a disconnect rest and a sear. The sear translates along a longitudinal axis between a rest position and a break point and also moves in an arc around a rotational axis from the break point to a disconnect position. The sear has a hammer side that presses against and rotates the hammer's cam end of as the sear moves between the rest position and the break point and thereby rotates the hammer's striking end around the hammer's pivot point between its seated and cocked positions. The support side contacts the disconnect rest's face as the sear moves between the rest position and the break point. The support side has an edge that is located at the ledge at the break point position. The hammer spring forces the sear to the disconnect position as the edge moves past the ledge.

20 Claims, 7 Drawing Sheets

TRIGGER MECHANISM

CROSS-REFERENCE TO RELATED APPLICATIONS

This application claims priority from U.S. Provisional Patent Application Ser. No. 61/552,499 filed on Oct. 28, 2011 which is hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to a trigger mechanism, and more particularly to a trigger mechanism for a firearm.

2. Related Art

There are a number of trigger mechanisms that have been used for firearms, including trigger mechanisms that are particularly designed for single-barrel pistols and multi-barrel pistols. In particular, there are double-action trigger mechanisms that have been designed for Derringer-type pistols. Additionally, there are existing trigger mechanisms which can maintain a constant pressure throughout a trigger pull and can allow for an adjustment of the pressure which is required for the trigger pull, i.e, the trigger pull weight. However, none of these known trigger mechanisms provide an operation that is as smooth and efficient as the trigger mechanism provided in the present invention. In particular, none of these known trigger mechanisms combine the mechanical advantage of a wedge element (generally, an inclined plane) in the sear assembly that works in combination with the hammer spring to control the trigger pull weight as the hammer is forced to rotate from its seated position to its cocked position.

SUMMARY OF THE INVENTION

The present invention is for a trigger mechanism that has a hammer, a hammer spring, a disconnect rest and a sear assembly. In one embodiment, the sear assembly translates along a longitudinal axis between a rest position and a break point position and also moves in an arc around a rotational axis from the break point position to a disconnect position. The sear assembly has a hammer side that presses against and rotates a cam end of the hammer as the sear assembly moves between the rest position and the break point position and thereby rotates the striking end of the hammer around the hammer's pivot point from its seated position to its cocked position. The support side contacts a face of the disconnect rest as the sear assembly moves between the rest position and the break point position, and the support side has an edge that is located at the ledge at the break point position. The hammer spring forces the sear assembly to the disconnect position as the edge moves past the ledge.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and does not limit the trigger mechanism invention, its application, or uses. The trigger mechanism 10 of the present invention is preferably used for firearms 100. As will be appreciated from the description below and corresponding drawings, the unique features and arrangements of the trigger mechanism 10 could be used for actuating and triggering devices other than firearms.

Figure 1A:
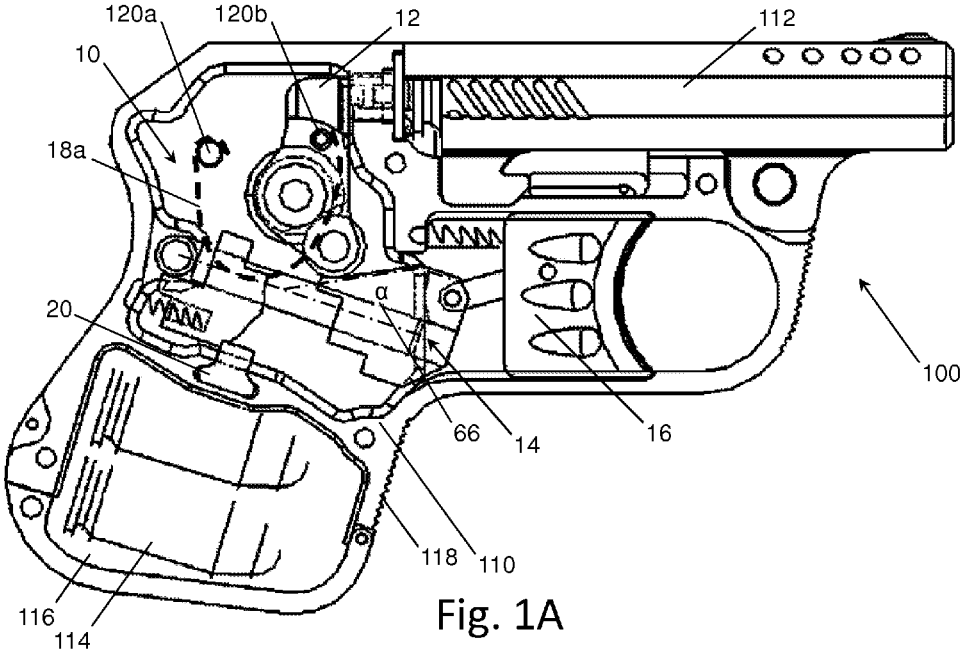
FIGS. 1A and 1B are cross-sectional views of a single-barrel firearm and a double-barrel firearm, respectively, with the trigger mechanism of the present invention.
Figure 1B:
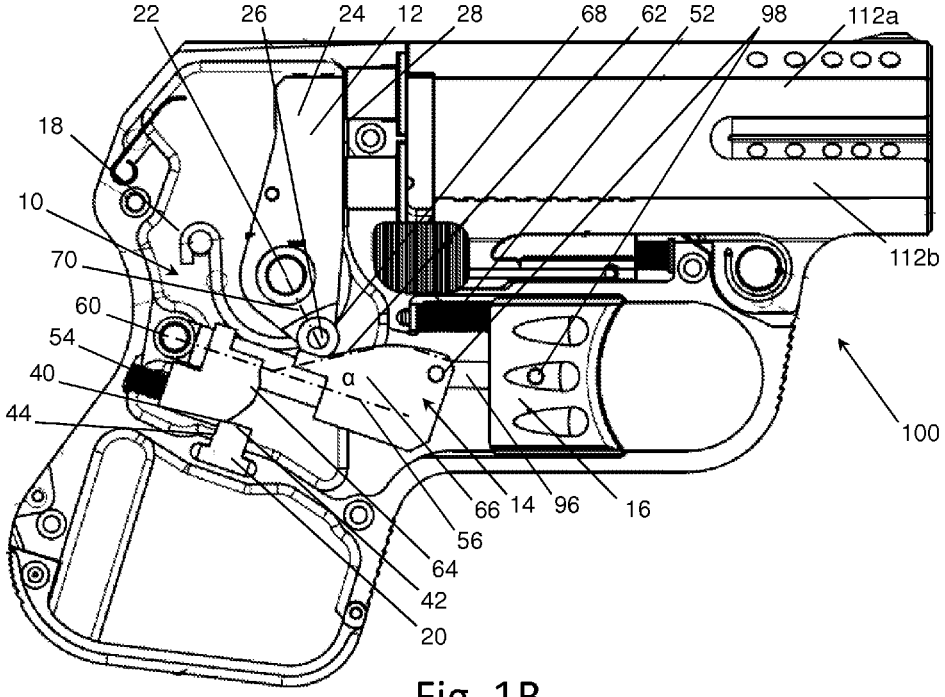

As shown in FIGS. 1A, 1B and 2, the trigger mechanism 10 is fixed within the frame 110 of a firearm 100. In particular, a hammer 12, sear assembly 14 and trigger pull 16 are positioned in a pistol frame 110. The hammer 12 has a pivot point 22 between a striking end 24 that extends towards the breech plate 28 and a cam end 26 that contacts the sear 14. A hammer spring 18 biases the hammer 12 in a seated position 30 against the breech plate 28. The sear assembly 14 and trigger pull 16 operate in combination with each other and to rotate the hammer into its cocked position 32 and to release the hammer so that the hammer spring snaps it back to its seated position 30 in a striking action. The sear 14 is supported by a disconnect rest 20 while the trigger pull 16 forces the sear from its rest position 34 to its break point position 36. As discussed in detail below, the trigger pull 16 pushes the sear past its break point position 36 and the hammer spring forces the sear to its disconnect position 38.

As respectively illustrated in FIGS. 1A and 1B, the trigger mechanism 10 can be incorporated into a single-barrel firearm 100*a* or a multi-barrel firearm 100*b*. Although pistols are shown in these drawings, it will be appreciated that the trigger mechanism can be used in other firearms, particularly including rifles and shotguns. Additionally, while the firearms shown in the drawings are breech loading firearms, it will be appreciated that the trigger mechanism can be combined with known ratcheting mechanisms for revolvers and can be incorporated into a semi-automatic firearm with reloading through a clip.

Figure 2A:
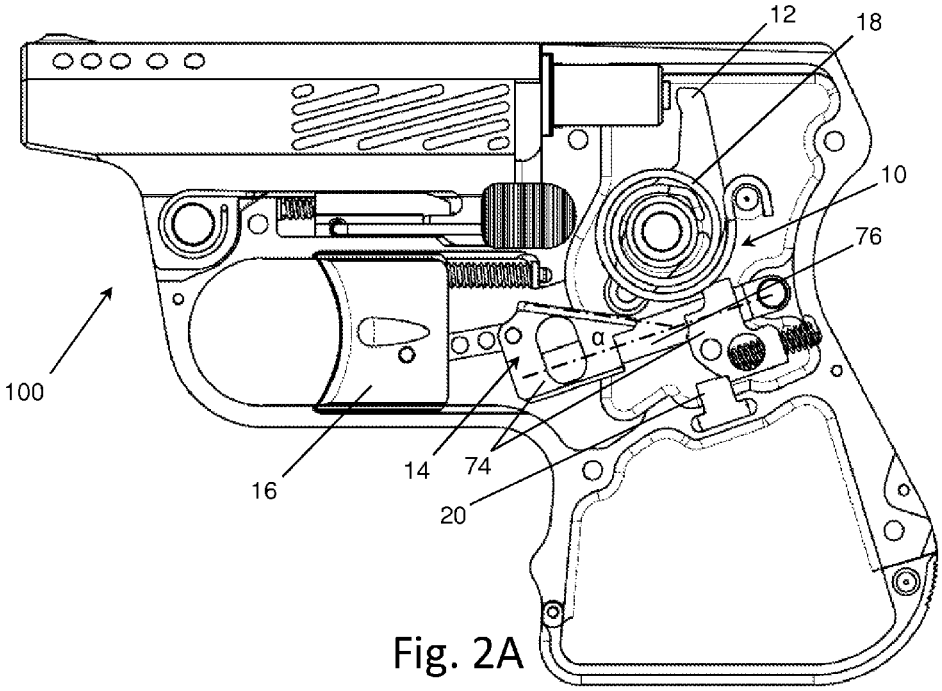
FIGS. 2A and 2B are cross-sectional views of an alternative single-barrel firearm and a double-barrel firearm, respectively, with the trigger mechanism of the present invention.
Figure 2B:
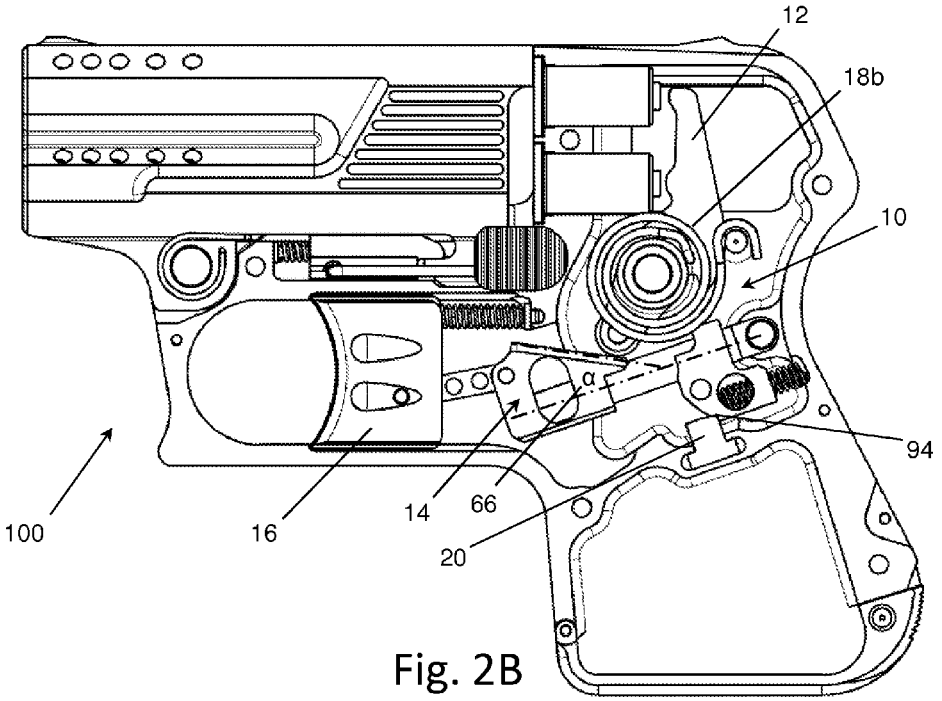

The use of the trigger mechanism 10 according to the present invention is shown in FIGS. 2A and 2B with alternative single-barrel and double-barrel firearms that can fire a shotgun shell or another round, such as a .410 shotgun shell or a .45 Colt cartridge. In this embodiment, the firearm can shoot either caliber one at a time. By opening the barrel 112 after the discharge, the shell can be automatically ejected or the shell could be manually extracted. In each one of the embodiments, it is possible to store ammunition 114 in a compartment 116 within the grip 118. For the multi-barrel embodiments shown in FIGS. 1B and 2B, it will also be appreciated that various indexing mechanisms can be incorporated into the hammer 12 so that sequentially pulling the trigger 16 will cause the hammer to first strike the firing pin of the shell in one barrel 112*a* and subsequently strike the firing pin of the shell(s) in the other barrel(s) 112*b*. As shown in FIG. 1, the hammer spring 18 may be a torsion spring 18*a* without any coil, and FIG. 2 illustrates an alternative torsion spring 18*b* which has a planar spiral coil.

Figure 3:
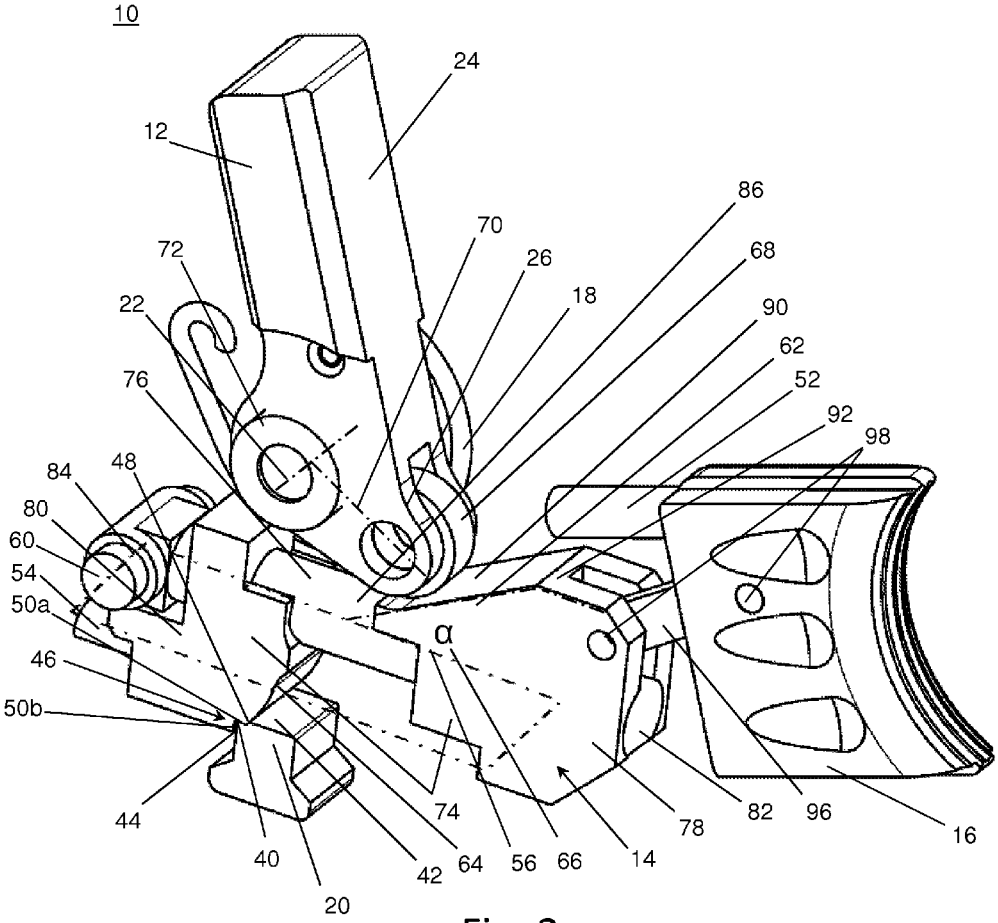
FIG. 3 is a detail isometric view of the trigger mechanism.
Figure 4A:
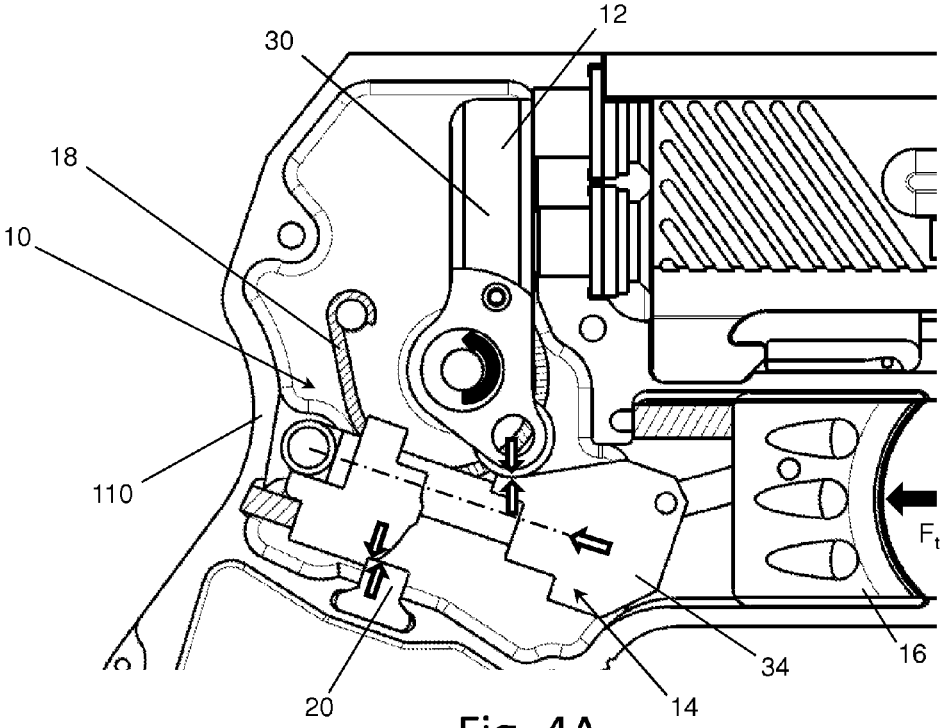
FIGS. 4A-4F are detail views of the progression for the cocking, release and return of the trigger mechanism.
Figure 4B:
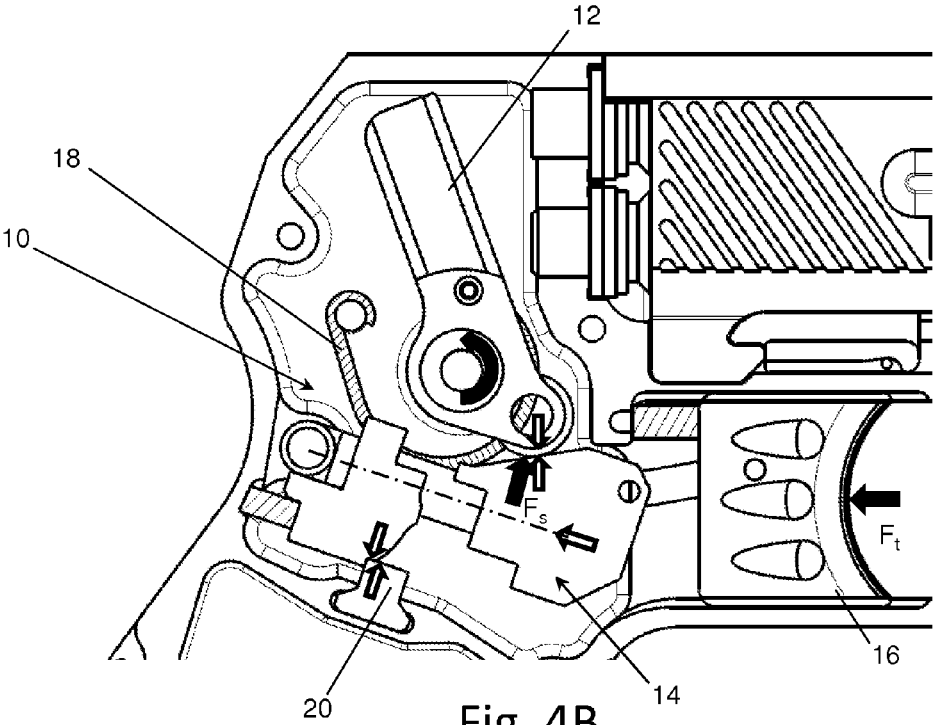
Figure 4C:
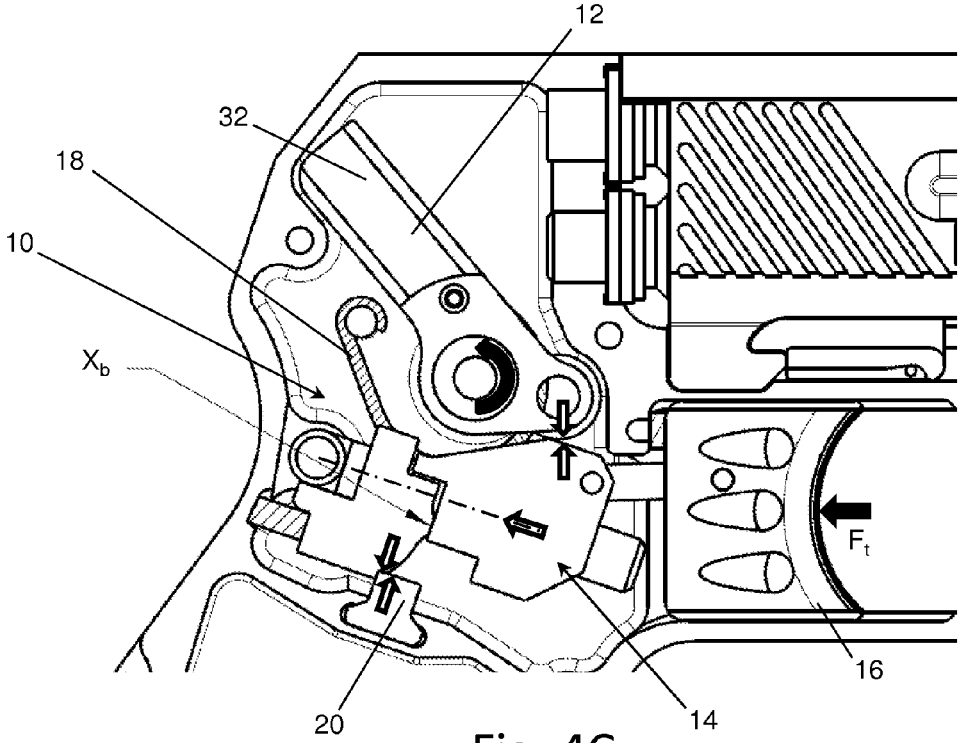
Figure 4D:
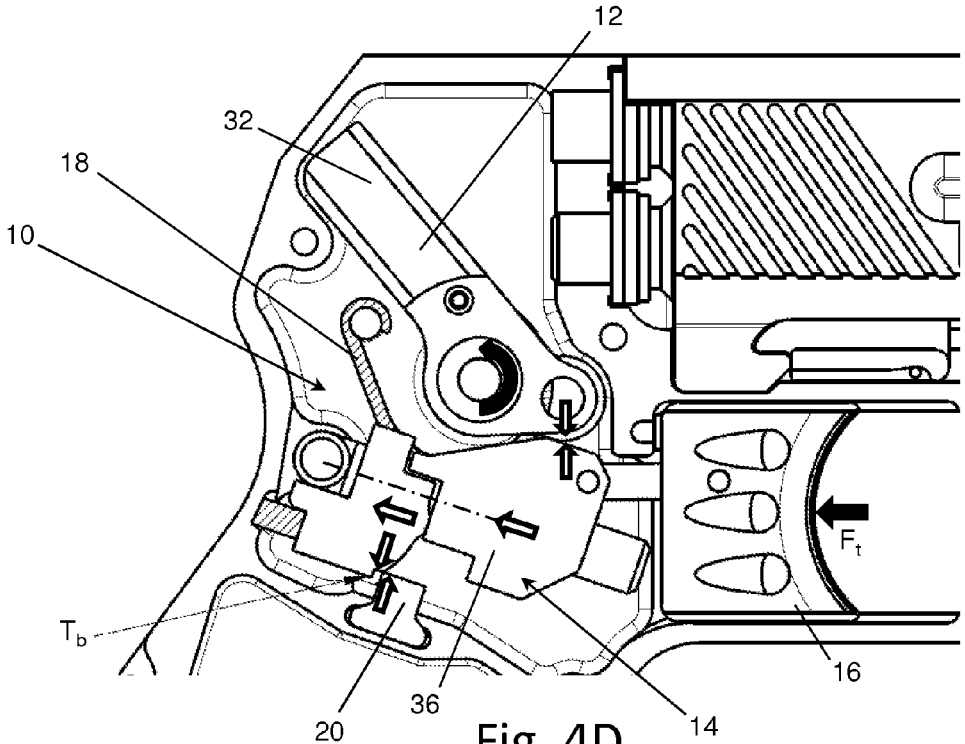
Figure 4E:
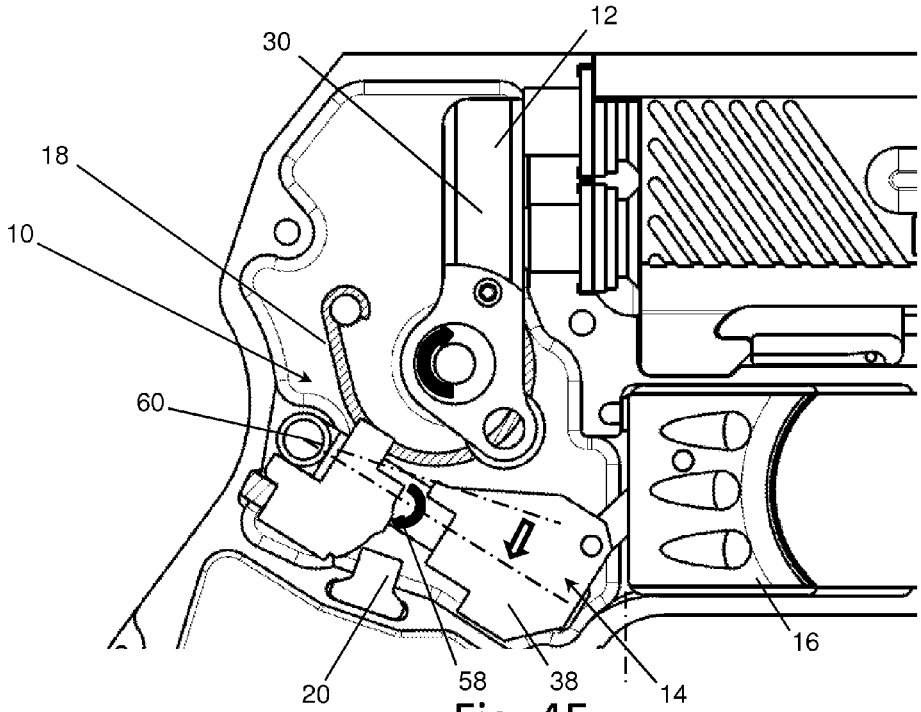
Figure 4F:
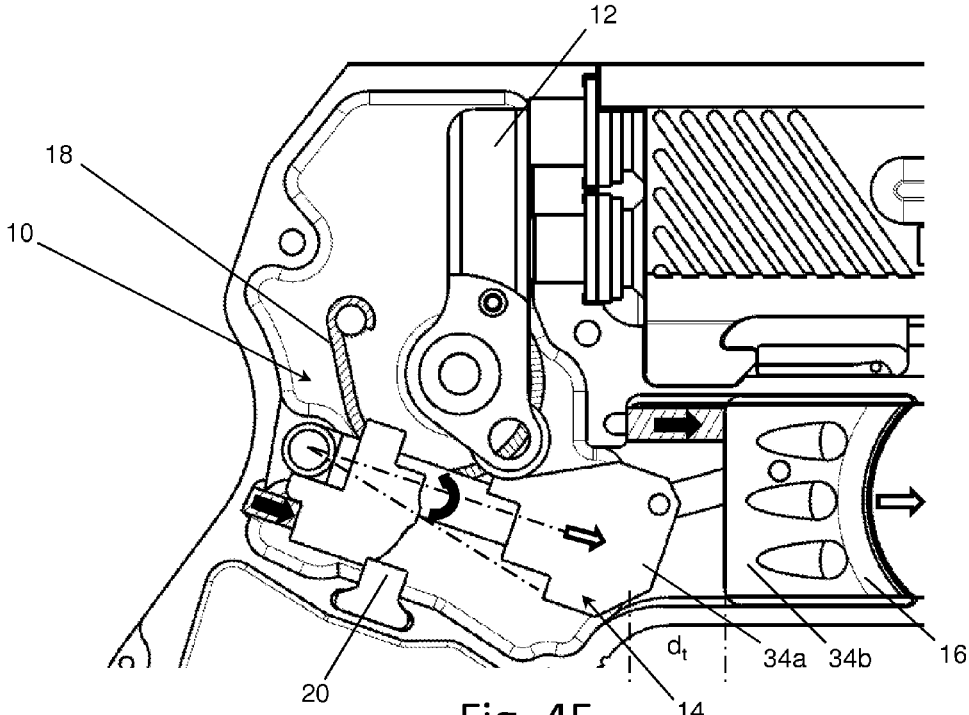

The elements of the trigger mechanism 10 according to the present invention for a firearm are shown in detail in FIG. 3, and the operations of the sear assembly 14 and trigger pull 16 to move the hammer 12 from its seated position 30 to its cocked position 32 are shown in FIGS. 4A-4C. With the hammer 12 in its cocked position 32, the trigger pull 16 moves the sear assembly 14 to the break point 36 of the trigger mechanism 10, as shown in FIG. 4D. Any further movement of the trigger pull 16 past the break point 36 will push the supporting portion of the sear assembly 14 off of a ledge 40 on the disconnect rest 20 to a disconnect position 38, thereby removing the support for the sear force that opposes the hammer spring force and causing the striking action as shown in FIG. 4E in which the hammer 12 rotates from its cocked position 32 and strikes the ammunition at the breech plate 28. As shown in FIG. 4F, when the trigger finger force ($F_t$) is removed from the trigger pull 16, the trigger return spring 52 and sear return spring 54 respectively bias the trigger pull 16 and the sear assembly 14 back to their respective rest positions 34*a*, 34*b*, i.e. the rest configuration.

The rest 20 has a supporting face 42 and a sidewall 44 on either side of the ledge 40. The face 42 of the disconnect rest 20 supports the sear 14 as generally described above. The sear 14 preferably has a notch 46 that has an edge 48 and a pair of sides 50*a*, 50*b* that are in full contact with the disconnecting rest's supporting face 42 and sidewall 44 when it is in the rest position 34. As described in further detail below, when the sear assembly 14 is pushed to the break point position 36, the notch 46 is pushed to the point where the edge 48 of the notch is the only portion of the sear 14 that is being supported the face 42 of the rest right at the ledge 40. Any further force applied to the sear assembly 14 will push the edge 48 off the ledge 40 so that the sear moves past its break point position 36 and is forced to the disconnect position 38. When the sear assembly 14 returns back from its disconnect position 38 to its rest position 34, the notch 46 positions the end of the sear that is supported by the disconnect rest 20 in a set location relative to the rest.

According to the general principles of the present invention, the sear translates along a longitudinal axis 56 between the rest position 34 and the break point position 36 and then moves in an arc 58 around a rotational axis 60 from the break point position 36 to a disconnect position 38. The sear 14 has a hammer side 62 and a support side 64 opposite from the hammer side. As the sear translates along its longitudinal axis 56 between the rest position 34 and the break point position 36, the sear's hammer side 62 presses against and rotates the cam end 26 of the hammer 12 around the pivot point 22, thereby rotating the striking end 24 of the hammer 12 around the pivot point 22 from the seated position 30 to the cocked position 32. The angle ($\alpha$) between the plane of the hammer side 62 and the plane of support side 64 forms a wedge 66 which, along with the spring constant ($k_h$) of the hammer spring 18, and to a lesser degree the spring constant ($k_t$) of the trigger return spring 52, defines the force ($F_t$) that is necessary to pull the trigger.

The wedge 66 can have one or more curved sides as shown in FIG. 1B or flat sides as shown in FIG. 1A which can produce a constant trigger pull weight for moving the sear 14 from the rest position 34 to the break point position 36, i.e., as the hammer 12 rotates from its seated position 30 to its cocked position 32. The support side 64 of the sear contacts the supporting face 42 of the disconnect rest 20 as the sear translates between the rest position 34 and the break point position 36. The support side 64 has an edge positioned proximate to the ledge 40 at the break point position 36. As indicated above, once the edge moves past the ledge 40, the hammer spring 18 forces the sear from the break point position 36 to its disconnect position 38 and the hammer 12 snaps back from the cocked position 32 in its striking action.

The wedge 66 serves as an inclined plane which provides a mechanical advantage within the sear assembly 14, and it works in combination with the hammer spring 18 to control the trigger pull weight as the hammer 12 is forced to rotate from its seated position 30 to its cocked position 32. As shown in FIG. 4B, the wedge 66 efficiently transfers the trigger pull force ($F_t$) into a normal sear force ($F_s$), perpendicular to the wedge's direction of travel, that is applied to the hammer 12 through a roller bearing 68 along its rotational arm 70, i.e., the distance between the center of the roller bearing and the hammer's pivot bearings 72. For a given spring constant ($k_h$) in the hammer spring 18, there is a direct relationship between the wedge angle ($\alpha$) and the trigger pull weight, such that an increase in the wedge angle increases the trigger pull weight while a decreased wedge angle decreases the trigger pull weight. For a given hammer rotational arm 70, an increased wedge angle ($\alpha$) would shorten the trigger pull distance ($d_t$) that is necessary to rotate the hammer 12 from its seated position 30 to its cocked position 32. Of course, there is a direct relationship between the hammer's spring constant ($k_h$) and the trigger pull weight so different hammer springs 18 can vary the trigger pull weight.

The sear assembly 14 is preferably formed by a block assembly 74 that is slidingly arranged on a guide rod 76. As particularly illustrated in FIGS. 1-4, the block assembly 74 preferably includes a wedge block 78 and a disconnect block 80 that each has a central passage 82 that is positioned on and slides relative to the guide rod 76. The guide rod 76 has a pivoting end 84 and a distal end 86 that can rotate relative to the pivoting end which is fixed to the frame 110. The wedge block 78 is supported by the guide rod 76 at its distal end, and is connected to the trigger pull 16 through an arm 96 that has a rotating joint 98 at each end. The disconnect block 80 is positioned on the guide rod 76 between the pivoting end 84 and the wedge block 78 and supports the other elements in the sear assembly 14, namely the guide rod 76 which in turn supports the wedge block 78.

When providing support to the sear assembly 14, the disconnect block 80 is positioned on the supporting face 42 of the disconnect rest 20. The wedge block 78 includes a ramp surface 90 that is arranged the wedge angle ($\alpha$) which is an acute angle relative to a guide plane that is produced by the longitudinal and rotational axes 56, 60 of the sear's guide rod 76. The ramp surface 90 is the hammer side 62 of the sear that presses against and rotates the cam end 26 of the hammer 12, thereby cocking the hammer 12. The wedge block 78 also has a contact region that engages a side of the disconnect block 80 as the hammer 12 reaches the cocked position 32 and preferably includes a cocked hammer surface 92 that is adjacent to the ramp surface 90 and is arranged substantially parallel to the guide plane. In the preferred arrangement, there is no further rotation of the hammer 12 as the hammer cam translates along the cocked hammer surface 92 to the break point of the trigger mechanism 10.

The disconnect block 80 has a base surface 94 that contacts the supporting face 42 of the disconnect rest 20 and supports the guide rod 76 as the wedge block 78 is pushed by the trigger pull 16 from its rest position 34 to the break point position 36. In the preferred arrangement, the disconnect block 80 remains stationary while the wedge block 78 moves from the rest position 34 to the point where the wedge block engages the disconnect block. As particularly shown in FIG. 4C, this point of engagement ($X_b$) or contact region between the blocks 78, 80 preferably coincides with the cocked hammer transition point at which the hammer cam moves from the wedge block's ramp surface 90 to its cocked hammer surface 92.

As described above, one side 50*a* of the notch 46 can serve as the base surface 94 that engages the disconnect rest 20, and the length of this side defines the distance in which the wedge block 78 pushes the disconnect block 80, i.e., the distance from the other side 50*b* of the notch to the edge 48 of the disconnect block 80. This distance can be coextensive with the engagement of the blocks and the trigger mechanism's break point and can be calibrated to ensure the engagement of the blocks coincides with the cocked hammer transition point. Also, the disconnect block 80 may have a slightly curved face that helps to position the disconnect block 80 as it is pushed past the ledge 40 and is forced into the disconnect position 38.

The hammer 12 is pivotally supported by the frame, preferably by a pair of pivot bearings 72 on opposite sides of the hammer's pivot point 22 that attach to the frame's opposing side walls. In the preferred embodiment, the cam end 26 of the hammer 12 includes a roller bearing 68 that contacts the hammer side 62 of the sear 14. As the wedge block 78 slides on the guide bar, the roller bearing 68 allows the hammer's cam end 26 to smoothly roll along the ramp surface 90 and the cocked hammer surface 92.

At the trigger break point ($T_b$) of the trigger mechanism 10, as particularly shown in FIG. 4D, the hammer 12 is cocked and the wedge block 78 has pushed the disconnect block 80 so that the edge 48 of the disconnect block is at the ledge 40 of the disconnect rest 20. Any further depression of the trigger pull 16 to the firing position results in the wedge block 78 pushing the edge 48 of the disconnect block 80's base surface 94 over the ledge 40. Without the engagement between the base surface 94 and the supporting face 42, there is no support for the sear components to oppose the hammer spring 18 which is preferably fixed to the frame 110 by a pin 120*a* at one end and fixed to the hammer 12 by another pin 120*b* at its other end. Free from the opposing sear force, the hammer spring 18 forces the components of the sear assembly 14 into the disconnect position 38 and produces the hammer's striking action. The sear assembly 14 will not return to the rest position 34 while the trigger pull 16 remains in the firing position. When the pressure on the trigger pull 16 is removed, the trigger return spring 52 biases the trigger pull to its ready or rest position 34*b*, and the sear return spring 54 biases the sear assembly 14 back to its rest position 34*a*.

Figure 5A:
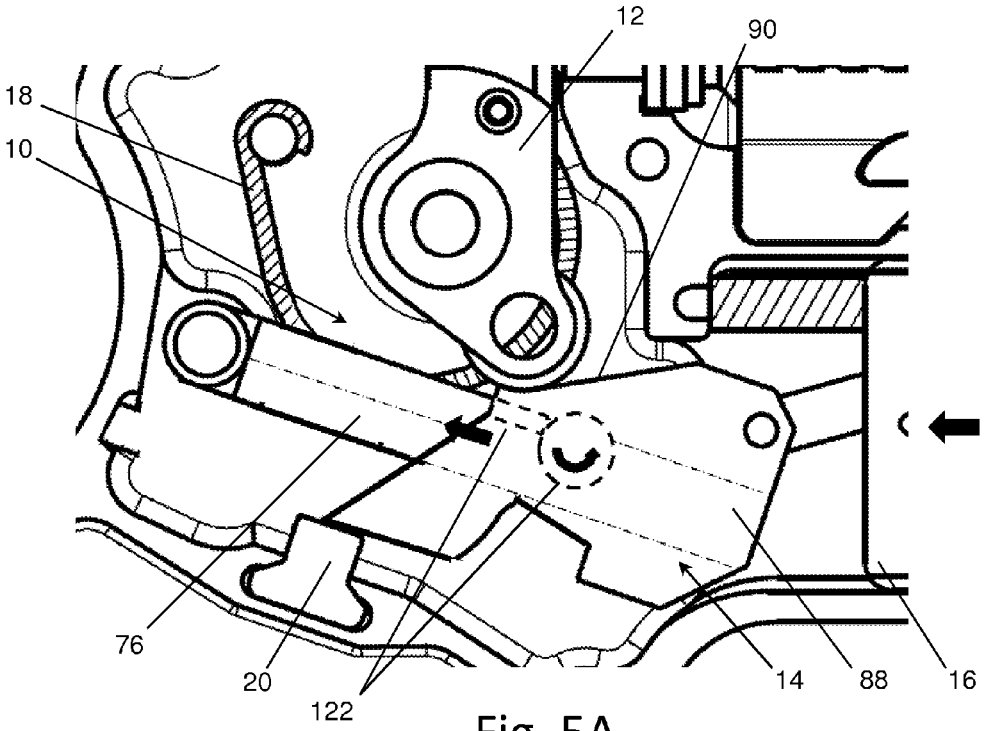
FIGS. 5A and 5B are alternative embodiments of the sear assembly.
Figure 5B:
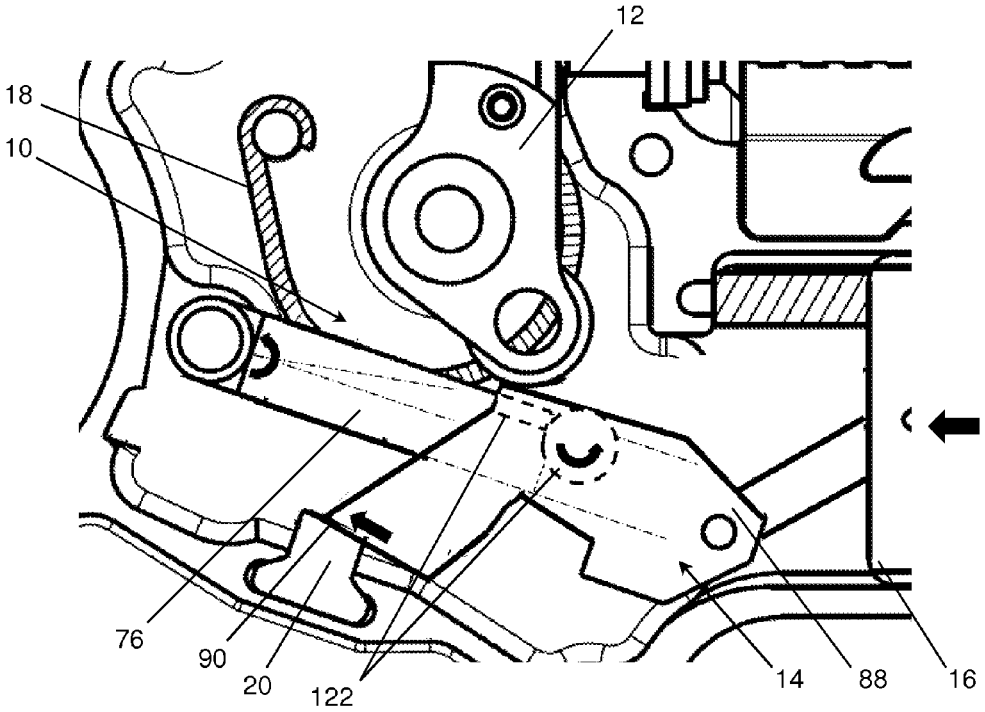

The arrangement of the sear assembly 14 components provides an efficient way to cock and release the hammer 12 followed by a quick return of the components into their rest position 34*a* as the trigger pull returns to its ready position 34*b*. It will be appreciated that changes could be made to the arrangement of the sear assembly 14 components according to the overall teaching of the present invention. For example, alternative embodiments of the trigger mechanism 10 with different arrangements of the sear assembly 14 may combine the disconnect block 80 with the wedge block 78 into a single disconnect wedge block 88, such as shown in FIGS. 5A and 5B. Similar to the embodiment described above, these blocks would slide on the guide rod 76 until the trigger mechanism 10 reaches the break point and then they would rotate on the guide rod 76 when the hammer spring 18 is released.

In these alternative embodiments, the return of the block arrangements may not be as efficient as in the preferred embodiment described above. These alternative arrangements may require an additional locking rotational element 122 in the block. The locking element would prevent the block from rotating as it slides on the guide rod 76 from the rest position 34 to the break point position 36 but would allow the block to rotate after it passes the break point and while it slides back on the guide rod 76 back to the rest position 34. As evident from the alternative arrangements, the disconnect wedge block 88 can have the ramp surface 90*a* on the hammer side 62 of the sear assembly 14 as shown in FIG. 5A, or it can be rearranged with the disconnect rest 20 so that the ramp surface 90*b* is on the disconnect side of the sear assembly 14 as shown in FIG. 5B. These alternative arrangements show that the guide rod's longitudinal axis 56 can rotate to push on the trigger as the block translates from the rest position 34 to the break point position 36 as shown in FIG. 5B, or the arrangement can keep the guide rod's longitudinal axis 56 constant while the block is translating as shown in FIG. 5A.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A trigger mechanism for a firearm, comprising:

a hammer having a first end, a second end and a pivot point between said first end and said second end, said first end of said hammer having a seated position and a cocked position;

a hammer spring biasing said first end of said hammer toward said seated position;

a disconnect rest having a face, a sidewall and a ledge between said face and said sidewall;

a sear assembly operable to translate along a longitudinal axis between a rest position and a break point position and further operable to move in an arc around a rotational axis from said break point position to a disconnect position, said sear assembly having a hammer side and a support side opposite from said hammer side, wherein said hammer side presses against and rotates said second end of said hammer as said sear assembly moves between said rest position and said break point position and thereby rotates said first end of said hammer around said pivot point from said seated position to said cocked position, and wherein said support side contacts said face of said disconnect rest as said sear assembly moves between said rest position and said break point position, wherein said support side comprises an edge positioned proximate to said ledge at said break point position, and wherein said hammer spring forces said sear assembly to said disconnect position as said edge moves past said ledge.

2. The invention of claim 1, wherein said sear assembly is further comprised of a block assembly slidingly arranged on a rotating guide rod, wherein said block assembly is selected from the group of assemblies consisting of a unitary disconnect wedge block and a wedge block separate from a disconnect block, and wherein said block assembly has a ramp surface on at least one of said hammer side and said support side.

3. The invention of claim 1, wherein said hammer side of said sear assembly comprises a ramp surface generally arranged at an acute angle relative to a guide plane defined by said longitudinal axis and said rotational axis.

4. The invention of claim 3, wherein said hammer side of said sear assembly further comprises a cocked hammer surface arranged substantially parallel to said guide plane.

5. The invention of claim 3, wherein said sear assembly further comprises a guide rod, a wedge block and a disconnect block, wherein said guide rod has a pivoting end and a distal end, wherein said disconnect block is slidingly arranged between said pivoting end and said wedge block and wherein said edge is provided on said disconnect block, wherein said wedge block is slidingly arranged proximate to said distal end of said guide rod and wherein said ramp surface is provided on said wedge block and wherein said wedge block comprises a contact region positioned to engage said disconnect block as said hammer reaches said cocked position, and wherein said contact region pushes said edge past said ledge when said sear assembly moves past said break point position.

6. The invention of claim 1, wherein said hammer further comprises a pair of pivot bearings on opposite sides of said pivot point and a roller bearing located at said second end, and wherein said hammer spring forces said hammer from said cocked position to said seated position while forcing said sear assembly said from said break point position to said disconnect position.

7. The invention of claim 1 further comprising a trigger pull and an arm connecting said trigger pull to said sear assembly through a pair of rotating joints at opposite ends of said arm, wherein said trigger pull further comprises a trigger return spring and said sear assembly further comprises a sear return spring, and wherein said trigger return spring and said sear return spring respectively bias said trigger pull and said sear assembly in said rest position.

8. The invention of claim 1, wherein said sear assembly further comprises a notch proximate to said edge, wherein a first side of said notch contacts said face of said disconnect rest when said sear assembly is in said rest position and a second side of said notch adjacent to said first side contacts said sidewall of said disconnect rest when said sear assembly is in said rest position.

9. A trigger mechanism for a firearm, comprising:

a hammer having a first end, a second end and a pivot point between said first end and said second end, said first end of said hammer having a seated position and a cocked position;

a hammer spring biasing said first end of said hammer toward said seated position;

a disconnect rest having a face, a sidewall and a ledge between said face and said sidewall;

a sear assembly comprising a guide rod and a block assembly, wherein said block assembly slides along said guide rod between a rest position, a break point position and a disconnect position, and wherein said guide rod has a pivoting end and a distal end that rotates about said pivoting end between a break point orientation and a disconnect orientation, said block assembly having a hammer side and a support side opposite from said hammer side, wherein said hammer side presses against and rotates said second end of said hammer as said block assembly moves between said rest position and said break point position and thereby rotates said first end of said hammer around said pivot point from said seated position to said cocked position, and wherein said support side contacts said first face of said disconnect rest as said block assembly moves between said rest position and said break point position, wherein said support side comprises an edge positioned proximate to said ledge at said break point position, and wherein said hammer spring forces said block assembly to said disconnect position while forcing said guide rod from said break point orientation to said disconnect orientation and said hammer from said cocked position to said seated position as said edge moves past said ledge.

10. The invention of claim 9, wherein said block assembly is selected from the group of assemblies consisting of a unitary disconnect wedge block and a wedge block separate from a disconnect block, and wherein said block assembly has a ramp surface on at least one of said hammer side and said support side.

11. The invention of claim 10, wherein said block assembly is said unitary disconnect wedge block, wherein said unitary disconnect wedge block is further comprised of a locking rotational element, wherein said locking rotational element prevents said unitary disconnect wedge block from rotating as it slides on said guide rod from the rest position to the break point position and allows the unitary disconnect wedge block to rotate between said break point position and said disconnect position.

12. The invention of claim 10, wherein said block assembly is said wedge block separate from said disconnect block, wherein said disconnect block is slidingly arranged between said pivoting end and said wedge block and wherein said edge is provided on said disconnect block, wherein said wedge block is slidingly arranged proximate to said distal end of said guide rod and wherein said ramp surface is provided on said wedge block and wherein said wedge block comprises a contact region positioned to engage said disconnect block as said hammer reaches said cocked position, and wherein said contact region pushes said edge past said ledge when said sear assembly moves past said break point position.

13. The invention of claim 10, wherein said ramp surface is generally arranged at an acute angle relative to a guide plane defined by a rotational axis of said pivoting end of said guide rod and a longitudinal axis between said pivoting end and said distal end of said guide rod.

14. The invention of claim 9, wherein said hammer further comprises a pair of pivot bearings on opposite sides of said pivot point and a roller bearing located at said second end, said roller bearing contacting said hammer side of said block assembly.

15. The invention of claim 9 further comprising a trigger pull and an arm connecting said trigger pull to said sear assembly through a pair of rotating joints at opposite ends of said arm, wherein said trigger pull further comprises a trigger return spring and said sear assembly further comprises a sear return spring, and wherein said trigger return spring and said sear return spring respectively bias said trigger pull and said sear assembly in said rest position.

16. The invention of claim 9, wherein said support side further comprises a notch proximate to said edge, wherein a first side of said notch contacts said face of said disconnect rest when said sear is in said rest position and a second side of said notch adjacent to said first side contacts said sidewall of said disconnect rest when said sear is in said rest position.

17. A trigger mechanism for a firearm, comprising:

a hammer having a first end, a second end and a pivot point between said first end and said second end, said first end of said hammer having a seated position and a cocked position;

a hammer spring biasing said first end of said hammer toward said seated position;

a disconnect rest having a face, a sidewall and a ledge between said face and said sidewall;

a sear assembly having a rest configuration, a break point configuration and a disconnect configuration, wherein said sear assembly comprises a block assembly and a guide rod, wherein said guide rod has a pivoting end and a rotating distal end, wherein said block assembly is positioned on said guide rod toward said distal end in said rest configuration and translates on said guide rod toward said pivoting end to said break point configuration, wherein said block assembly has a hammer side and a support side forming a wedge between said second end of said hammer and said face of said disconnect rest, said wedge forcing said second end of said hammer to rotate as said block assembly translates on said guide rod and thereby rotating said first end of said hammer around said pivot point from said seated position to said cocked position, wherein said support side of said wedge comprises an edge positioned proximate to said ledge when said sear assembly is in said break point configuration, and wherein said hammer spring forces said sear assembly into said disconnect configuration while forcing said hammer from said cocked position to said seated position as said edge moves past said ledge.

18. The invention of claim 17, wherein said block assembly is selected from the group of assemblies consisting of a unitary disconnect wedge block and a wedge block separate from a disconnect block.

19. The invention of claim 17, wherein said wedge is generally arranged at an acute angle relative to a guide plane defined by a rotational axis of said pivoting end of said guide rod and a longitudinal axis between said pivoting end and said distal end of said guide rod.

20. The invention of claim 17 further comprising a trigger pull and an arm connecting said trigger pull to said sear assembly through a pair of rotating joints at opposite ends of said arm, wherein said trigger pull further comprises a trigger return spring and said sear assembly further comprises a sear return spring, and wherein said trigger return spring and said sear return spring respectively bias said trigger pull and said sear assembly in said rest position.

* * * * *